United States Patent [19]

Stackhouse et al.

[11] Patent Number: 5,046,492

[45] Date of Patent: Sep. 10, 1991

[54] CLEAN ROOM HELMET SYSTEM

[76] Inventors: Wyman H. Stackhouse, 3201 Poinsettia Ave., Manhattan Beach, Calif. 90266; Ian M. Williamson, 555 No. Harbor Dr., Redondo Beach, Calif. 90277

[21] Appl. No.: 219,220

[22] Filed: Jul. 15, 1988

[51] Int. Cl.[5] ..... A62B 18/02; A62B 7/00

[52] U.S. Cl. ..... 128/200.27; 128/205.12; 128/205.22; 128/205.25; 128/205.19; 128/200.28; 128/204.18

[58] Field of Search ..... 128/205.19, 205.27, 128/201.24, 201.25, 201.29, 200.27, 200.28

[56] References Cited

U.S. PATENT DOCUMENTS

| | | | |
|---|---|---|---|
| 196,206 | 10/1877 | Emery | 128/205.19 |
| 1,005,816 | 10/1911 | Drager | 128/205.27 |
| 1,196,539 | 8/1916 | Goldberg | 128/205.27 |
| 1,298,404 | 3/1919 | Ramanoff | 128/205.27 |
| 1,691,648 | 11/1928 | Drager | 128/205.27 |
| 3,736,927 | 6/1973 | Misagi | 128/201.25 |
| 4,019,508 | 4/1977 | Der Estephanian | 128/202.19 |
| 4,186,735 | 2/1980 | Henneman | 128/201.25 |
| 4,331,141 | 5/1982 | Pokhis | 128/201.25 |
| 4,352,353 | 10/1982 | Bolton | 128/201.24 |
| 4,494,538 | 1/1985 | Anorte | 128/201.25 |
| 4,506,667 | 3/1985 | Anorte | 128/201.25 |
| 4,522,639 | 6/1985 | Anorte et al. | 128/201.25 |
| 4,534,344 | 8/1985 | Hughes | 128/201.25 |
| 4,549,542 | 10/1985 | Chien | 128/201.25 |
| 4,590,951 | 5/1986 | O'Connor | 128/201.25 |
| 4,676,236 | 6/1987 | Piorkowski | 128/201.25 |
| 4,677,976 | 7/1987 | Fujinuma | 128/201.25 |

*Primary Examiner*—Edgar S. Burr
*Assistant Examiner*—Kimberly L. Asher
*Attorney, Agent, or Firm*—Singer & Singer

[57] ABSTRACT

There is described an improved clean room helmet system including a helmet having an inlet port and an exhaust port. Connected to the inlet port is a portable and mobile pressure filtering system for suppling filtered air to the helmet. A separate portable and mobile vacuum filtering system is connected to the outlet port on the helmet for exhausting and filtering all air removed from the interior of said helmet before exhausting the air into the atmosphere. All air fed to the helmet is filtered and all air exhausted from the helmet is filtered thereby protecting the user from breathing contaminated air. The system also protects those persons in the environment from air being exhausted from the helmet into the environment. A deflector located within the helmet prevents pressurized air entering the inlet port from being fed directly to the exhaust port located on the helmet.

1 Claim, 1 Drawing Sheet

Fig. 1
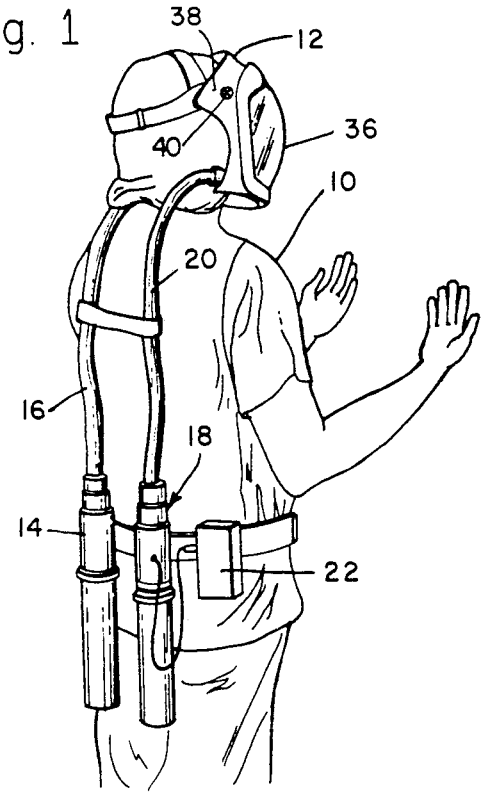
Fig. 2.
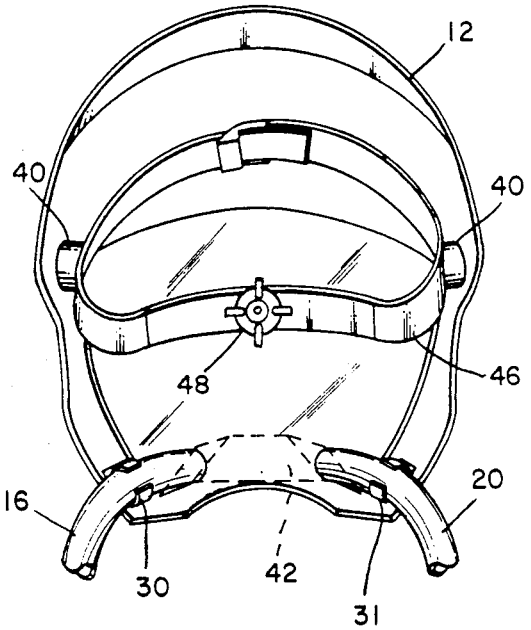
Fig. 3.
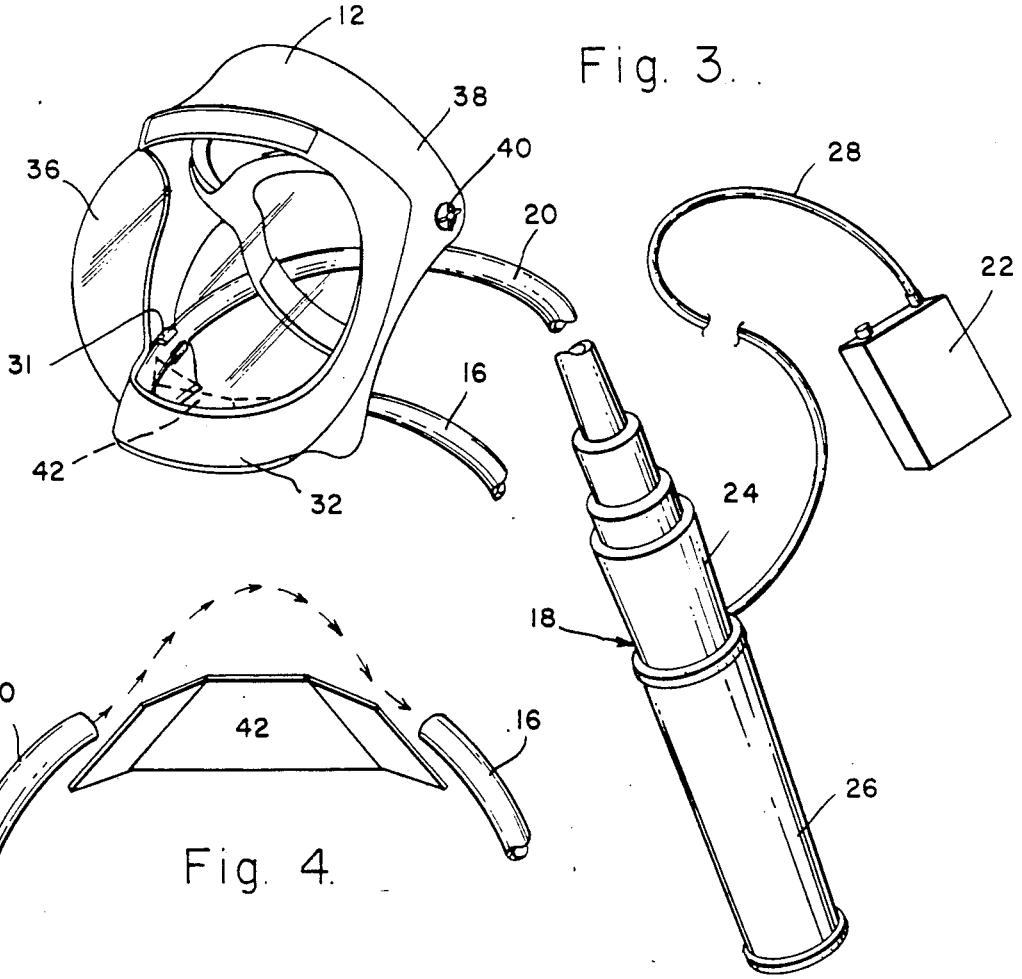
Fig. 4.

CLEAN ROOM HELMET SYSTEM

This invention relates to portable and mobile apparatus used by persons such as doctors located in an operating room working in a clean room environment, and more particularly to helmet systems in which the user is protected from contaminated air in the environment while at the same time, the environment is protected from contaminated air being exhausted from the user's helmet.

The concept of providing a clean room environment for a doctor to operate in has long been recognized by the prior art as a means of protecting the patient from external infections.

The concept of a clean room has also been recognized by industry, and specifically in the Space Field and Micro Miniature Field where it has been found necessary to provide a clean room environment for the assembly and manufacture of critical parts such as microelectronic assemblies and gimbals for bearings where contamination caused by external particulates could destroy the equipment being manufactured and assembled.

In the recent past, operating room personnel have become very concerned with the possibility of themselves being contaminated with viruses carried by the patients that are being operated upon. The problem arises when the operating personnel use lasers of different intensity and magnitudes to treat the open wound of a patient who may or may not have an AIDS virus or other highly communicable disease. The intense heat generated by the laser beam literally explodes the cell containing the objectionable virus, which in all probability is thrown in an arbitrary fashion around the operating room and in the vicinity of the operating personnel.

Therefore the need has arisen not only for a system that would protect the environment from external contamination possibly supplied by those located in the clean room, but also to protect personnel from particulates existing in the clean room environment that may be generated as a result of procedures being used or materials generated in the clean room itself.

A review of the prior art shows many systems for protecting either the user or the environment, but in no case has there been discovered a system that protects both the user and the environment and where the system is completely mobile and portable for allowing the user to move freely about without being tied to external devices.

For example, U.S. Pat. No. 4,502,480 discloses a helmet system used in combination with a filter to protect the user from breathing contaminated air. Unfortunately there is nothing shown in the system to protect the environment from air being exhaled by the user.

Referring now to U.S. Pat. No. 4,019,508 there is shown an early version of a self-contained system for use by operating room personnel which purports to filter air emanating from the user into the environment thereby protecting the environment from the user's exhaust air. The disclosed system unfortunately only shows how the environment is protected from air that is normally exhausted by the wearer during surgery. There is nothing disclosed to show how the wearer is protected from air that is being breathed from the environment.

Some very early prior art devices attempted to exhaust the air exhaled by the user to filtering devices located external the user. These devices used umbilical cords or other tubed devices and were not portable or mobile. These devices also only protected the environment and did not protect the user. Such units were not successful since they were not self-contained and they prohibited the user from moving about freely. Examples of such system are U.S. Pat. No. 3,058,463 and 3,955,570.

In the present invention, there is described a truly portable and mobile filtering system in which the helmet is sealed to prevent unfiltered ambient air from entering the helmet. A portable and mobile pressure vacuum system delivers filtered ambient air into an inlet port associated with the helmet worn by the user. A separate portable and mobile vacuum system also worn by the user is connected to an exhaust port associated with the helmet worn by the user and exhausts and filters all air from the helmet before returning the filtered air to the clean room environment.

In accordance with the preferred embodiment of the present invention, there is disclosed a helmet having a solid transparent face plate and having an inlet port on one side and an outlet port on the other side which is adapted to be worn by the user. A portable and mobile pressure filtering system adapted to be carried by the person of the user is connected to the inlet port on said helmet for suppling filtered air to the helmet through the inlet port. The pressure filtering system consists of an electric motor, a battery pack and a filtering element connected in circuit to filter all air supplied to said helmet to be breathed by the user.

A separate portable and mobile vacuum filtering system also adapted to be carried on the person of the user is connected to the outlet port on said helmet for exhausting and filtering all air removed from the interior of said helmet through the exhaust port. The vacuum filtering system consists of an electric motor, battery pack and a filtering element connected in circuit to filter all air removed from the helmet. In all respects, the vacuum filtering system and the pressure filtering system are identical.

In order to improve the efficiency of the helmet system, an air deflector is located in the helmet between the inlet port and the exhaust port for deflecting the filtered incoming air from the inlet port into the vicinity of the user's nose portion, thereby providing optimum breathing efficiency before the air in the helmet is exhausted through the exhaust port.

The Clean Room Helmet System described allows the user to always breath filtered air while operating within the clean room environment and at the same time, ensures that only filtered air will be exhausted into the clean room thereby ensuring that the clean room will not be contaminated by any particulates being exhausted from the user's helmet.

Further objects and advantages of the present invention will be made more apparent by referring now to the accompanying drawings:

FIG. 1 is a perspective view of a user wearing a Clean Room Helmet System having a vacuum and pressure filtering system according to the present invention;

FIG. 2 is a perspective view of the helmet system and filter unit as illustrated in FIG. 1;

FIG. 3 is a rear view of the helmet of FIG. 2; and

FIG. 4 illustrates an air deflector unit installed in the helmet of FIGS. 2 and 3.

Referring now to FIG. 1 there is shown a user 10 located in the clean room environment and wearing a helmet 12. Located on each side of helmet 12 is a mobile, portable pressure filtering system 14 connected to a flexible tube 16 and to helmet 12 for drawing air from the environment and filtering the air and feeding the air through the flexible tube 16 into the confines of the helmet 12. Also located and worn by the user 10 is a portable and mobile vacuum filtering system 18 connected to helmet 12 by means of a flexible tube 20 and arranged to draw the exhaust air from the confines of helmet 12 and filtering said air before discharging the filtered air into the environment of the room.

The vacuum filtering system 18 and the pressure filtering system 14 are both portable and mobile and otherwise identical. The vacuum system 18 is operated by means of battery pack 22 carried by the user 10. In the similar fashion, a separate battery pack, not illustrated, is also carried by user 10 and used to supply operating power to the pressurized filtering system 14.

Referring now to FIG. 2 there is shown a clean room helmet 12 connected by means of tube 20 to vacuum filtering system 18 and consisting of an electric motor 24 and a Hepa filter unit 26. The electric motor 24 is connected via suitable electrical cables 28 to a battery pack 22. The tube 20 is held to the helmet 12 by means of a suitable clamp 30 which holds one end of tube 20 in close proximity to the chin guard portion 32 of the helmet. A suitable clamp, not illustrated, connects one end of tube 16 while the other end is connected to the pressure filter system 14 more fully illustrated in FIG. 1.

Located on the front portion of helmet 12 is a solid transparent face plate 36 affixed to a frame portion 38. The face plate 36 is pivotally mounted to the helmet 12 by means of pivots 40 thereby allowing the user to lift and open the face plate should that be necessary and without removing the complete helmet 12.

A bifurcated deflector 42 is located inside the helmet chin section 32 between the ends of hoses 20 and 16 as is more fully illustrated in connection with FIG. 3 and 4.

The deflector 42 is preferably attached to the chin section 32 with double faced tape or a suitable adhesive material. The function of the deflector 42 is to deflect the incoming air from the pressure filter unit 14 and hose 16 into the vicinity of the user's nose in order to achieve optimum breathing comfort and thereby prevents the air from being immediately removed from the helmet area by means of the vacuum filter system 18 connected to hose 20.

Referring now to FIG. 3 there is shown a rear view of the helmet 12 illustrating an adjustable head band 46 adapted to fit around the head of the user and in which the diameter of the head band is adjustable by means of knob 48. FIG. 3 more fully illustrates how the lens portion 36 is tiltable around the head band by means of pivots 40 which allows the user to tilt the lens portion up and away without removing the complete helmet 12.

As shown in FIG. 1, both complete filtering systems 14 and 18 together with associated battery pack 22 are adapted to be clipped onto a belt worn by the user. In this way, the user has complete portability and mobility without being connected to any wall units or external units when performing his tasks, either in the operating room or in the clean room environment. It should also be noted that all objectionable particulate will be removed by the filtering units before reaching the user, and all particulates from the user will be filtered before reaching the environment. In this manner, the user is protected from the environment and the environment is protected from the user thereby providing a safe arena for both the user, which in the preferred embodiment will be operating personnel, and the patient which is located in the operating area.

Although the invention has been described in detail with respect to presently preferred embodiments of the invention, it should be understood that the invention may be practiced using similar functioning but different elements within the scope of the appended claims.

I claim.

1. A Clean Room Helmet System for substantially isolating a person from the environment and the environment from the person comprising:

a helmet for covering the head portion of a user, said helmet having a solid translucent face plate and an inlet port and an exhaust port for allowing intake air to enter the helmet and exhaust air to leave the helmet respectively.

a portable and mobile pressure filtering system adapted to be carried on the person of the user and connected to said inlet port on said helmet for supplying filtered air to said helmet, said pressure filtering system consisting of an electric motor, battery pack and filtering element connected in circuit to filter all air supplied to said helmet, a portable and mobile vacuum filtering system adapted to be carried on the person of the user and connected to said outlet port on said helmet for exhausting and filtering all air removed from the interior of said helmet portion, said vacuum filtering system consisting of an electric motor, battery pack and filtering element connected in circuit to filter all air removed from said helmet, and an air deflector located in said helmet between said inlet port and said outlet port for deflecting the filtered incoming air from the inlet port into the vicinity of the user's nose portion whereby optimum breathing efficiency is obtained before the air is exhausted out the exhaust port, and in which said helmet includes a chin portion and said deflector fits inside said chin portion between said inlet port and said exhaust port and is attached to said helmet with double faced adhesive tape.

* * * * *